United States Patent [19]

Kerschenbaum et al.

[11] Patent Number: 4,800,741

[45] Date of Patent: Jan. 31, 1989

[54] ELECTRICALLY AND MANUALLY OPERABLE DOOR LOCK WITH CONVENIENT BACKSET SELECTION

[76] Inventors: Sidney Kerschenbaum; Barry Kerschenbaum, both of 135-60 233rd St., Rosedale, N.Y. 11422; Charles Kerschenbaum, 88-08 107th Ave., Ozone Park, N.Y. 11417

[21] Appl. No.: 905,312

[22] Filed: Sep. 9, 1986

Related U.S. Application Data

[63] Continuation-in-part of Ser. No. 464,620, Feb. 7, 1983, abandoned, which is a continuation-in-part of Ser. No. 663,283, Sep. 20, 1984, abandoned.

[51] Int. Cl.[4] ..... E05C 1/06; E05B 65/48

[52] U.S. Cl. ..... 70/13; 292/144; 292/149; 70/279

[58] Field of Search ..... 70/134, 277, 279, 280; 292/144, 149

[56] References Cited

U.S. PATENT DOCUMENTS

| | | | |
|---|---|---|---|
| 2,577,216 | 12/1951 | Spinello | 70/149 |
| 2,710,217 | 6/1955 | Gurtiss et al. | 292/341.18 |
| 2,727,772 | 12/1955 | Hamilton | 292/144 |
| 2,763,888 | 9/1956 | Billeter | 292/144 X |
| 3,078,704 | 2/1963 | Rifkin | 292/144 |
| 3,234,766 | 2/1966 | O'Brien | 292/144 X |
| 3,248,140 | 4/1966 | Flodell | 292/74 |
| 3,576,119 | 4/1971 | Harris | 292/144 X |
| 3,731,963 | 5/1973 | Pond | 292/144 |
| 3,751,086 | 8/1973 | Geringer | 292/144 |
| 3,753,316 | 8/1973 | Savarieau et al. | 292/144 |
| 3,781,683 | 2/1974 | Bright | 292/149 |
| 3,792,391 | 2/1974 | Ewing | 292/144 |
| 3,890,608 | 6/1975 | Peterson | 292/144 X |
| 3,989,286 | 11/1976 | Cleff | 292/181 |
| 4,073,518 | 2/1978 | Goodwin | 70/279 |
| 4,073,527 | 2/1978 | Schlage | 292/144 X |
| 4,099,752 | 7/1978 | Geringer | 70/279 X |
| 4,169,616 | 10/1979 | Peterson | 292/144 |
| 4,355,830 | 10/1982 | Rau | 292/144 |
| 4,372,419 | 2/1983 | Barnett et al. | 292/144 |
| 4,438,962 | 3/1984 | Soloviff et al. | 292/144 |
| 4,593,543 | 6/1986 | Stefanek | 292/144 |
| 4,615,548 | 10/1986 | McGee | 70/279 |
| 4,659,121 | 4/1987 | McGee | 292/144 |
| 4,677,834 | 7/1987 | Hicks | 292/144 |

FOREIGN PATENT DOCUMENTS

| | | | |
|---|---|---|---|
| 85459 | 9/1921 | Austria | 292/152 |

*Primary Examiner*—Richard E. Moore
*Assistant Examiner*—Vinh Luong
*Attorney, Agent, or Firm*—Bernard S. Hoffman

[57] ABSTRACT

A rim lock which includes a housing, a bolt displaceable in the housing, a strike which receives the bolt, a solenoid which is mounted on the housing and has a coil, a plunger which is axially reciprocal in the coil, a crosspiece fin which is disposed between and which is rigidly affixed to the plunger and the bolt, a front inner lever which has at least one pin and is rotationally mounted in the housing and is in mechanical communication with the crosspiece fin, a spring which is operatively braced between the crosspiece fin and the housing, apparatus which electrically energizes the coil, holding appartus which are operatively engageable between the bolt and the housing and mechanically retains the bolt, a key operated lock cylinder, a rear inner lever which has at least one pin and is rotationally mounted in the housing and is in mechanical communication with the crosspiece fin, and coupling apparatus which includes an interchangeable backset plate which is engaged between the key-operated lock cylinder and the bolt and which displaces the bolt axially upon operation of the key-operated lock cylinder. The interchangeable backset plate is one of a plurality of interchangeable backset plates each being removably mounted to the housing and each having a different backset so that a single rim lock can fit on doors with different size stiles and required backsets.

21 Claims, 4 Drawing Sheets

A'
13g
60
3a'
3b'
13c
3c'
13a
39c
13f
13d
47
13e 13h
100
13b
66
34'a
64
39b
61
64'
21a
34'b
65
63
61'
1
22
8
9
62
10
9a
9b
16
14a
2c
2
17
2b
20
16a
14'
15
23a
23
12b
25
24
23
23a
25a
12b
24a
12,23
23a
54
12c
23b
56
12b
55a
A'
55
4
50
100
5
16a
20
52
51
16
33
52
12b
56
12c
58
24
1
24a
32
57
15
22
7
37

ELECTRICALLY AND MANUALLY OPERABLE DOOR LOCK WITH CONVENIENT BACKSET SELECTION

CROSS REFERENCE TO RELATED APPLICATION

This application is a continuation-in-part of application Ser. No. 663,283 filed Sept. 20, 1984 which is a continuation-in-part of application Ser. No. 464,620 filed Feb. 7, 1983, both now abandoned.

FIELD OF THE INVENTION

The present invention relates to an electrically and manually operable door lock. More particularly, this invention concerns a rim lock of the type used on the inside surface of a shop door or the like where individuals are buzzed in and/or out by a shopkeeper or receptionist and where some sort of mechanical actuation of the lock is also possible, at least from outside the door.

BACKGROUND OF THE INVENTION

A remotely actuated door lock can be strike-centered, that is have its actuating mechanism in the strike on the doorjamb or in the lock on the door. Such a strike-centered lock has the disadvantage that it is fairly difficult to retrofit the door with the bulky strike mechanism, and such systems are normally easy to jimmy and otherwise circumvent.

There are many types of door-mounted locks. They may be incorporated in the doorknob assembly, as in U.S. Pat. No. 4,073,527 of Schlage. In another such arrangement as described in U.S. Pat. No. 2,763,888 of Billeter, a pneumatic door-mounted door closer is connected to a pneumatic actuator in a lock mechanism to withdraw the bolt momentarily as the door is just about closed, so that the door bolt does not noisily engage the strike. In U.S. Pat. No. 3,234,766 of O'Brien a small rotary output motor carries a worm on its output shaft that meshes with a gear-sector paul that operates the latch bolt. It is not structured to, or include backset choices, or include the bolt, crosspiece fin, plunger practically one piece assembly, held rigidly together directly in one axis line for greater efficiency and durability. Similarly, U.S. Pat. Nos. 3,576,119 and 3,751,086 of Harris and Geringer, respectively, have a solenoid mounted directly on the door. In U.S. Pat. No. 3,890,608 of Peterson the solenoid is linked to the bolt. A system kinematically identical to that of Peterson is seen in U.S. Pat. No. 4,169,616 also of Peterson which uses a pneumatic actuator.

All such arrangements are fairly bulky, making it impossible to mount them on the inside surface of the thin (narrow) stile of a standard metal-and-glass entrance door of the type used in shops and offices, etc., in such a manner that it can be actuated from outside the door by a standard rim key cylinder. A partial solution to this problem of retrofitting an existing (narrow) thin-stile door is proposed in U.S. Pat. No. 4,099,752 of Geringer. The mechanism of this arrangement is extremely complex, however.

With all these arrangements manual actuation of the lock is frequently impossible, and it is often also impossible to cut out the lock by holding it in a position with its bolt fully retracted. What is more, such locks are normally only set up for one particular type of installation, for instance, an in-swinging door; they cannot be adapted at the site to different setups. the Savarieau et al. and Bright references basically are to latch or fasten the door in a locked position rather than for an alternate to keep a door unlocked, and do not employ the bolt, crosspiece fin, plunger assembly structure. Curtiss et al. and Flodell's strikes do not use one part of the assembly for outswing doors and another means of the assembly for inswing doors, etc., and Rifkin, Hamilton, Cleff, Rau, Spinello, Ewing; Pond and Nikolaus have their relative differences too.

Note, O'Brien's 82 is a threaded member which engages mounting plate 28 and rear housing plate 16 the latter being locked in place by a key 84. It appears that 86 is a shaft on the other side connected to handle 90 and cam 88 and to reiterate O'Brien's invention is mainly a motor driven unit with added solenoid and with mechanical apparatus workings of a different character and different objective than of this present invention of backset choices and bolt, crosspiece fin, and plunger assembly structures, etc.

The other principal disadvantage of such locks is that they must be made in many different models to accommodate different features, depending on security requirements.

SUMMARY OF THE INVENTION

It is therefore an object of the present invention to provide an improved manually and electrically operable door rim lock.

Another object of this invention is the provision of such a manually and electrically operable door lock which overcomes the above-given disadvantages, that is, which is of small and simple construction, which can be adapted easily for different installations, and which can be held open manually if desired.

Another object of this invention which is to be mounted in conjunction with an outside standard key cylinder, is to be most easily fixedly mounted on the inside surface of a house, office, store or shopdoor, this door to contain such an outside key cylinder where the door may swing inward or outward when opened. These doors obviously are found to be differently manufactured, some made with less glass and more mounting on the door where door meets frame. Some with more glass and less stile space or mounting area in which to center the standard outside cylinder and for where the mechanical lock mechanism will be joined together with narrow stile doors. This problem can be more intensified in cases of a buck door frame when the door is outswinging and also by different gaps between door and frame.

The object of this invention, while also being electrically actuated and also otherwise mechanically actuated rim, is to face the above problems with this invention being structured to include with, and to accept also as part of itself, interchangeable backset plates or a backset plate with adjustable means. Giving a choice of various backset distance measurement for where the backset of this one lock can be set to, to match up easily with, where a standard mechanical rim key cylinder which may have already been drilled for and installed previously, or may need to be installed in the door to be used in conjunction with this lock invention.

It is also the object of this invention to provide within its already working essential parts. For instance, a shopkeeper may only wish to use the remote feature at certain times of the day, such as after dark, when greater care must be taken, the entrance being left open during the day. Similarly the situation might require an arrangement where people must be buzzed out as well as in, as opposed to a setup where the person leaving can open the lock himself on leaving. In addition it is occasionally necessary to combine the various systems, for example to be able to open the lock manually from the inside at certain times and not at others. The prior-art systems normally do not leave this type of leeway in application, offering only one style of operation per lock.

A rim lock according to this invention has a housing secured to the door stile face usually opposite the hinges of a hinged door and forming a guide extending along a longitudinal axis, a bolt displaceable in the guide along the axis between an inner position generally retracted in the housing and an outer position projecting axially therefrom, a strike on the frame post formed with a recess opening axially toward the door stile and receiving the bolt in the outer position thereof when the stile engages the frame post, and a solenoid mounted in the partition housing and having a coil centered on the axis and a plunger axially reciprocal in the coil and fixed on the bolt sandwiching a crosspiece fin. A spring is operatively braced between the bolt crosspiece fin and housing part and urges the bolt axially outward into the outer position. The solenoid coil can be electrically energized to pull the plunger and bolt, crosspiece fin assembly axially backward against the spring force into the inner position of the bolt. A hold-in latch is operatively engageable between the bolt and the housing for mechanically retaining the bolt in the inner position. A key-operated lock cylinder on the door stile face is coupled to the bolt fin plunger assembly for displacing same axially on key operation of the door cylinder. A manual operating element mounted and pivotal on the housing can be coupled to the bolt assembly for displacing bolt axially on manual pivoting of the element.

Thus with the system of this invention manual actuation from inside and outside in many ways is more easily possible, allowing the door to be opened in the morning from outside or opened from inside by someone leaving through the door. At the same time an in-line solenoid can be energized to retract the bolt both to permit someone to leave as well as to permit them to enter, if desired. In addition the bolt can be held in the retracted position if desired.

According to another feature of this invention is a radially opened recess on the bolt and a hold-open element axially nondisplaceable in the housing and engageable radially in the radial recess. This hold-open element can be a screw or a spring clip. This makes locking out of the remote actuator relatively simple. In one arrangement, the housing is provided with a tubular guide abutment axially aligned with the plunger but on the axially opposite side of the solenoid as the bolt. The plunger and bolt have an axially inwardly projecting extension formed with the radial recess and the latch element is carried on the guide abutment.

It is also within the scope of this invention to provide an inside cylinder mounted on the housing and connected to the element to rotate same. This cylinder can be used only to open the door from the inside, or can be set up to constitute the hold-open position, (unlocked).

According to a further feature of the invention, the housing has an intermediate partition, the bolt carries an abutment axially spaced therefrom, and the spring is a compression spring axially braced between the partition solenoid housing and the fin crosspiece abutment. Such construction is extremely compact and durable.

The knob element of the instant invention can also include a member engageable between the element and the housing for arresting same on the housing in one position permitting axial motion of the bolt assembly but not permitting pivoting of the element and in another position holding the bolt in the inner position and also not permitting pivoting of the element. This member can be a spring pin or a screw threaded in the element, in which case the housing is formed with at least two separate holes in which the screw is engageable in the respective positions. Thus a simple tool can be used to change the style of operation of the lock, something that can be done very easily.

In accordance with another feature of this invention, the multi-strike assembly includes a main block for an outswing door which can in itself be secured to the frame post and formed with a hole constituting the recess and with an angled ramp adjacent the hole. The bolt is engageable with the ramp on closing of the door so that on such closing the ramp cams the bolt into the inner position from which the bolt snaps out again into the recess of the strike when aligned therewith in the fully closed or locked position of the door.

The multi-strike assembly of this invention includes a L and or flat bracket adapted to be secured to the frame post with the main block and the backing block, and screws for securing the bracket to the main block, the bracket to the door frame post, and the main block to the backing block, for inswing dooor installations. This way it is possible to make such a multi-part strike adaptable to any style of installation, on a wood or metal door that swings in or out.

DESCRIPTION OF THE DRAWINGS

The above and other features and advantages will become more readily apparent from the following, it being understood that any feature described with reference to only one embodiment of the invention can be used where possible with any other embodiment. In the accompanying drawing.

DETAILED DESCRIPTION OF THE PREFERRED EMBODIMENTS

Figures 2, 3:
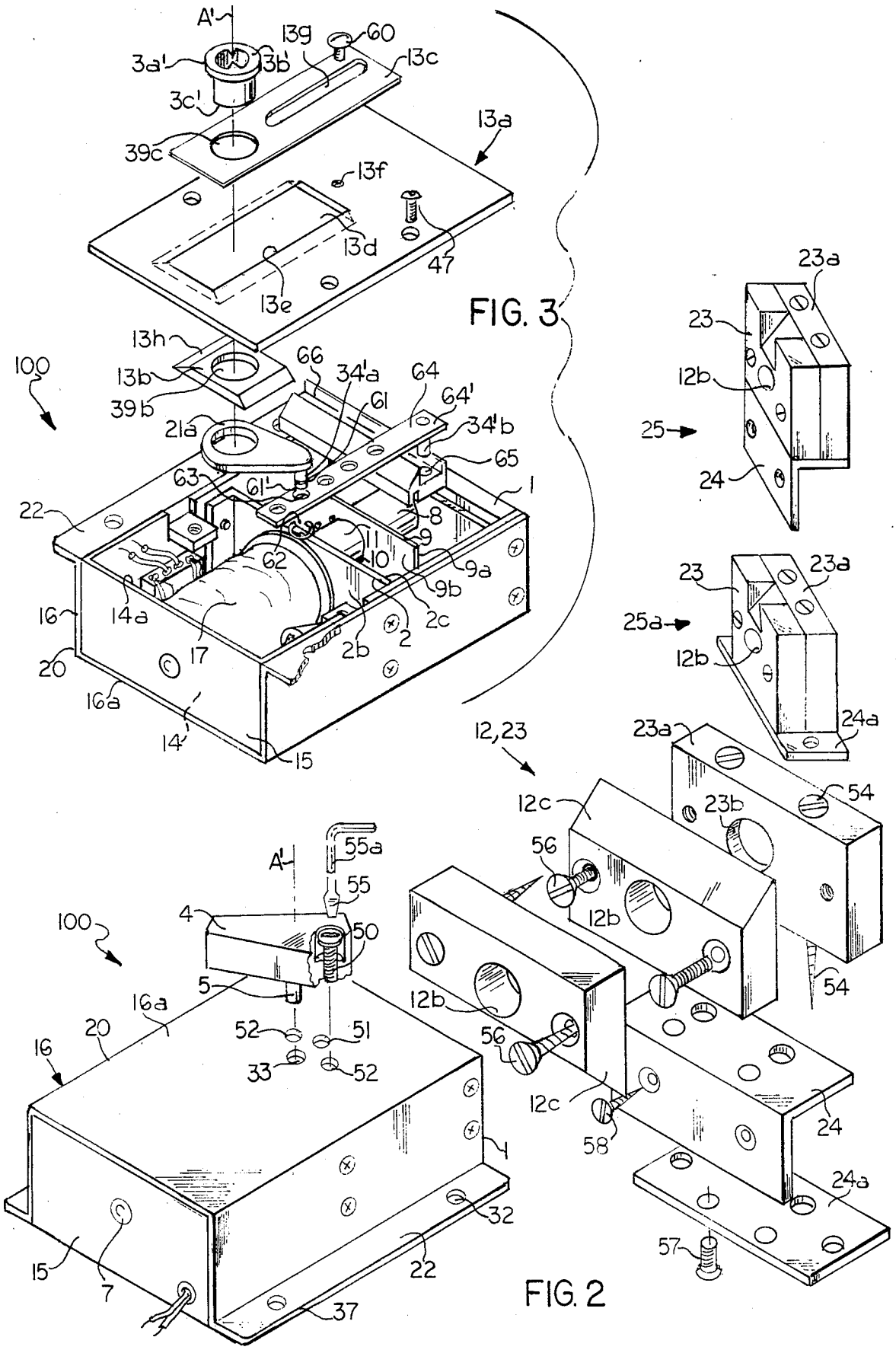
FIG. 2 is a partly schematic exploded perspective rear view of the lock with its multi-feature thumb knob and strike assembly.
FIG. 3 is a partly broken-away perspective view of the assembled lock and an exploded view of its adjustable backset plate in accordance with this invention.
Figure 8:
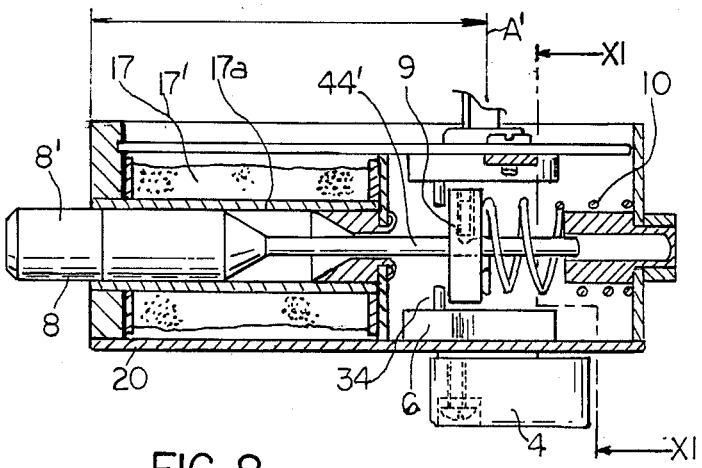
FIG. 8 is a vertical axial section through as variation of lock according to the invention.
Figure 9:
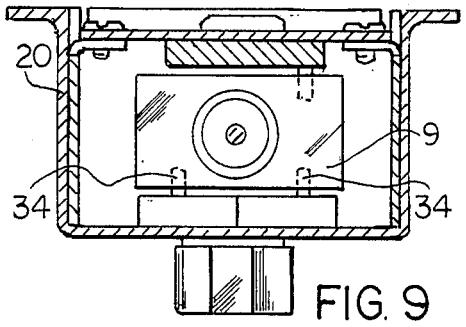
FIG. 9 is a section taken along line XI of FIG. 8.
Figure 5:
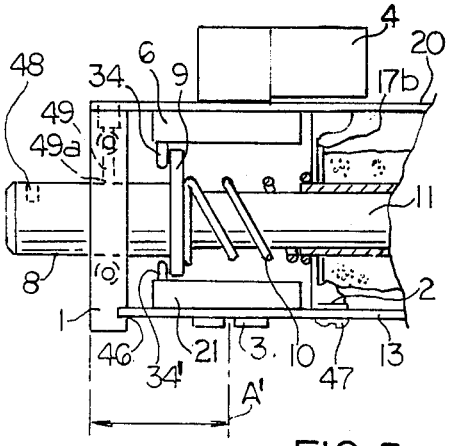
FIG. 5 is a small-scale horizontal section through the lock of FIGS. 1 through 3.
Figure 4:
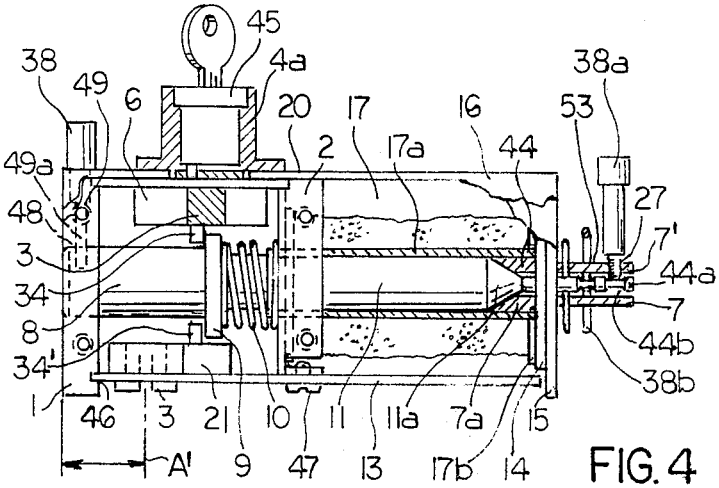
FIG. 4 is a small-scale horizontal section through the lock of the present invention but of the double-cylinder type.

As seen in FIGS. 1 to 9, the lock 100 according to the present invention has a parallelepiped metallic housing 20. The housing 20 includes casings 15 and 16 which are made of a durable material. An outer part 16*a* of the casing 16 contains door mounting holes 32 and a finger level 4. The finger level 4 is rigidly connected to a shaft 5. The shaft 5 is supported by and rotatably bears within a hole 33 in the casing 16. The shaft 5 is fixedly secured to a center 6*a* of a rotating inner lever 6, by a set screw 6'. The inner level 6 employs two pins 34 which are spaced apart and rigidly perpendicularly connected to a face 6*b* of the inner rotating lever 6. The two pins 34 are disposed a small and equal distance from an inner circumference 6*c* of the inner lever 6. The two pins 34 accommodate each of both directions that the finger lever 4 may be turned. In order to actuate a bolt 8 the pins 34 of the inner lever 6 bear against a surface 9*a* of a crosspiece fin 9 which is fixedly secured to the bolt 8. The crosspiece fin 9, through a hole 36, is clamped between the bolt 8 and a plunger 11 by means of male threads 35 of the bolt 8 and a female threaded hole 37 of the plunger 11. The lock 100 is mechanically engaged in a similar fashion from the rear of the lock 100, as shown in FIGS. 4 and 5, where a rear rotating lever 21 is actuated by a bushing 3 which can accommodate a standard type key cylinder (not shown). The bushing 3 bears in a hole 39 in an interchangeable backset plate 13. The housing 20 is formed from a thick bolt guide end plate 1, an internal partition 2 which is parallel to the bolt guide end plate 1, the interchangeable or an adjustable backset plate 13 and 13*a*, respectively, which is perpendicular to the bolt guide end plate 1 and seated in a groove 46 of the bolt guide end plate 1, an opposite end reinforcement buffer plate 14, and the two U-section casings 15 and 16. The two casings 15 and 16 are secured together by screws 47 threaded into the edges of the bolt guide end plate 1 and flanges 2*a* of the partition 2. The housing 20 is secured, as shown in FIGS. 10 and 11*a, b,* and *c,* to a rear face 31*a* of a stile 31, that is the vertical side member of a door, by screws 31*b* passing through the holes 32 in vertical flanges 22 of the casing 16. If the housing 20 is to extend past the stile 31 of a glazed door, a decorative cover plate can be provided to cover the visible outside face of the plate 13.

The lock 100 is basically centered on an axis A that extends horizontally about ½" behind the rear face 31*a* of the stile 31 it is to be mounted on. The bolt guide end plate 1 is formed centered on the axis A with a cylindrical bore 40 while the partition 2 has a slightly larger bore 41. The bolt 8 made of a strong durable material and the solenoid ore plunger 11 are of a cylindrical shape and extend along the axis A through the bores 40 and 41. The bolt 8 is snugly guided by the bore 40. The bolt 8 has the small-diameter male threaded extension 35 projecting axially inward, that is, to the right in FIG. 1, through the small-diameter hole 36 in the rigid abutment crosspiece fin 9, and is threaded into the female threaded hole 37 at an axially outer end face 11*a* of the plunger 11.

A solenoid 17 having a dielectric core tube 17*a* of non-magnetic material such as extruded brass or equivalent in durability is centered on the axis A and has a front end 17d which is received snugly in the hole 41. Also, the solenoid 17 has a front and rear end washers 17*b* that are axially engaged between a back face 2*b* of the internal partition 2 and a front face 14*a* of the end reinforcement plate 14. A rear end 17*c* of the core tube 17*a* is engaged over a magnetic attractor abutment 7 of stepped outer diameter. The rear end 17*c* of the core tube 17*a* is fitted in an axially centered bore 42 of the end reinforcement buffer plate 14 and an identical hole 43 in the casing 15. The crosspiece fin 9 is therefore fixed between the bolt 8 and plunger 11, which themselves are locked together. A helical compression spring 10 surrounding the plunger 11 is braced axially between a back face 9*b* of the crosspiece fin 9 and a front face 2*c* of the partition 2, urging the bolt 8 into the outer position as shown in FIGS. 5 and 9.

This single or two step double, pull and hold solenoid coil 17 is connected via a full-wave bridge rectifier 18 and a capacitor 19 to a series-connected power supply (not shown) formed by a bell-type stepdown transformer (not shown) connected to line, and a switch (not shown), typically a pushbutton switch behind the counter or receptionist's desk of the location employing the lock according to this invention. All wiring except for the transformer can be low voltage so as to be easy to install and very safe. When the switch is closed, the solenoid 17 pulls in the plunger 11, thereby retracting the bolt 8 and the crosspiece fin 9 against the force of the spring 10 so that it moves from the extended or out position shown in FIGS. 5 and 6 to the retracted position shown in FIGS. 4 and 7.

In addition to this electrical actuation of the bolt 8 it is also possible to actuate it manually. From outside the door, having the stile 31 as shown in FIGS. 10 and 11, this is done by having a standard stile-mounted rim lock door cylinder 30 positioned in the same manner as the cylinder for the standard stile-mount flop-type lever lock provided on glazed doors. The cylinder 30 is mounted in place by a standard backing plate that engages the rear face of the stile 31 and screws 26 which extend therefrom into the body of the cylinder 30, to either side of a rearwardly projecting actuating tongue or stem 36'. As is standard, the barrel of the cylinder 30 can be rotated by the appropriately bitted key about the horizontal axis A', which perpendicularly intersects the axis A, to identically rotate the flat stem 36'.

Figure 6:
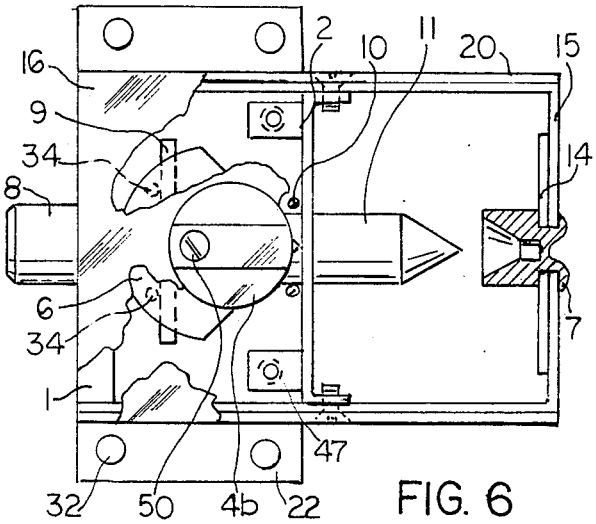
FIG. 6 is a partly broken-away front view vertical section showing a variation on the lock in accordance with this invention.

A front face 13' of the interchangeable backset plate 13 of the lock housing 20 is formed centered on the axis A' with the circular hole 39 which may be placed in one of many places on the interchangeable backset plate 13 along a line parallel to the axis line A depending on the relative circumstances of how lock 100 must be mounted on the stile 31 to join with the cylinder 30 mounted on the stile 31. Note is to be taken of the axis line A' and the placement of the lock housing 20 on the stile 31 in FIGS. 10, 11, 11*a* to 11*c*, 10*a* to 10*c*. Note is also to be taken of the distances on line parallel to axis line A from the bushing 3 on axis line A to the bolt end plate 1 in FIGS. 4, 5, 6 and 8. FIG. 5 shows a larger distance between the bushing 3 and the bolt-end plate 1 than the distance between the bushing 3 and the bolt-end plate 1 shown in FIG. 4. In FIG. 6 the distance is somewhere in between and FIG. 8 shows a distance still greater than that of FIG. 5. The hole 39 in which is journaled a cylindrical rear end 3*a* of the T-shaped coupling bushing 3 has a cross-slotted front end 3*b*. The stem 36' engages in one of slots 3*c* of the bushing 3, depending whether the cylinder 30 is of the vertical-or horizontal-stem type, and is therefore rotationally linked thereto. The bushing 3 in turn is fitted on the other side of the interchangeable backset plate 13 into the rear rotating lever 21 which has an eccentric actuating pin 34' extending parallel to but offset from the Axis A'. The pin 34' lies axially between the crosspiece fin 9 and the bolt-end plate 1 so that, when the bushing 3 and the rear rotating lever 21 rotate, the pin 34' will be able to engage and push back the bolt 8 by engagement with the crosspiece fin 9. A 90° rotation of the key is sufficient to withdraw the bolt 8 completely.

Figure 1:
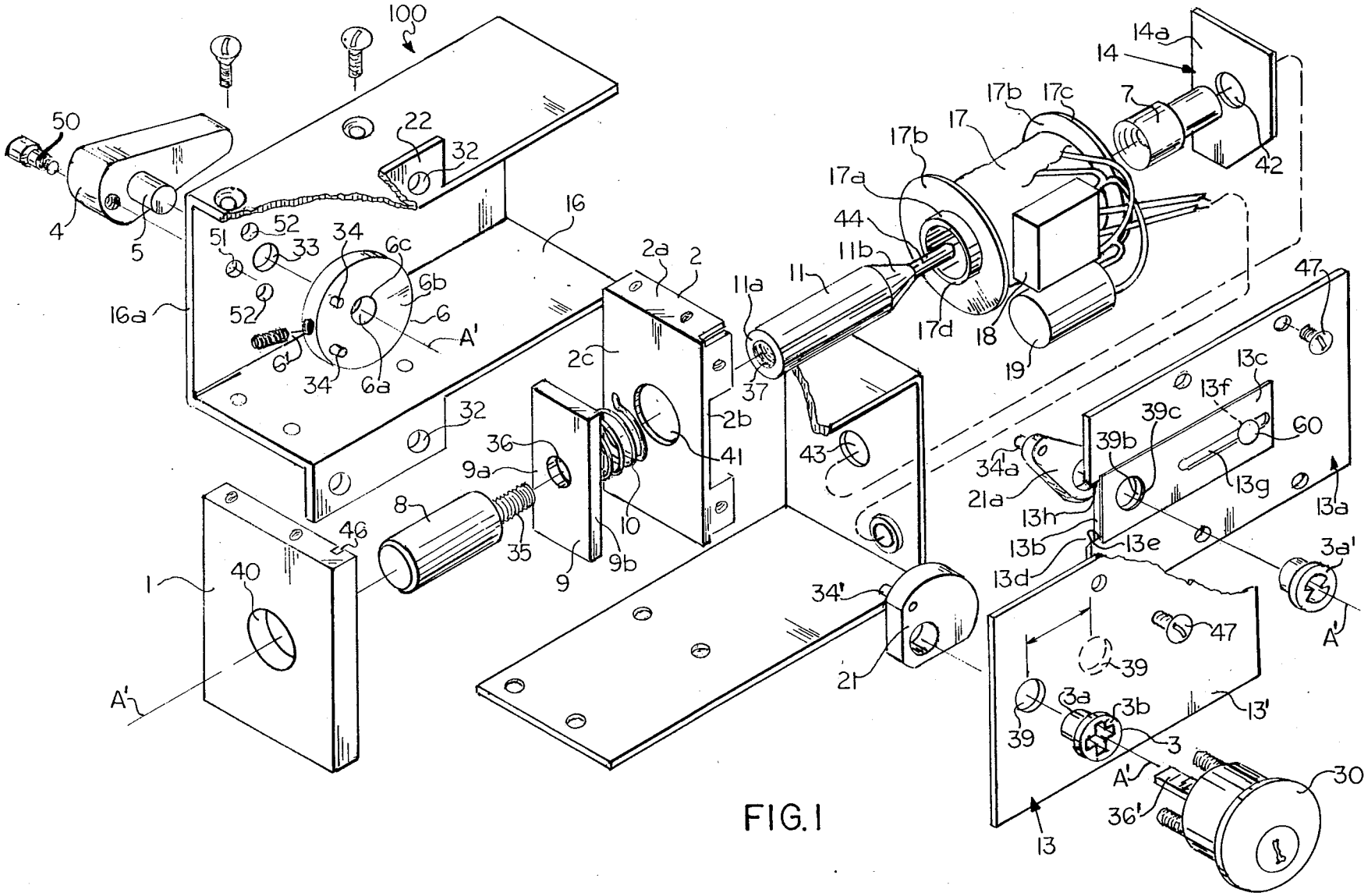
FIG. 1 is an exploded perspective front view of a lock according to this invention.

A similar function is accomplished with the adjustable backset plate 13a shown in FIGS. 1 and 3. The adjustable backset plate 13a is composed of a bushing 3a', which is similar to the bushing 3, and a rectangular backset slide plate 13c which contains a cylindrical bearing hole 39c to receive the bushing 3a' on one side along the center line of the longer length. A small distance from the axis A' in the backset slide plate 13c runs a thin slot 13g. The slot 13g extends almost to the end of the backset slide plate 13c. On the center line of the backset plate 13a running lengthwise to almost one end is a rectangular opening 13d which is slightly smaller than the rectangular slide plate 13c. At the sides of the opening 13d and running parallel to the center line, are 2 tracks 13e which mate with tracks 13h of a square slide 13b for controlling the sliding action thereon. A threaded hole 13f disposed in the adjustable backset plate 13a and parallel with the center line A controls the movement of the rectangular slide 13c along the center line A when joined with a screw 60. The screw 60 is tightened so that it may securely fasten the rectangular slide 13c in the desired position. Similar to the bushing 3, the bushing 3a' engages the stem 36' which is centered on the axis A'. The bushing 3a' in turn enters through the bearing hole 39c of the slide plate 13c, and is journaled there at a T end 3b'. Another end 3c' extends through the rectangular opening 13d of the adjustable backset plate 13a and enters through a bearing hole 39b of the square slide 13b. The bushing 3a' in turn is fitted on the other side of the plates 13c, 13a and 13b into an actuation element cam 21a which has an eccentric actuating pin 34'a extending parallel to but offset from the axis A'. The assembled adjustable backset plate 13a is screwed into the lock 100 using two of the four appropriate symmetrically placed mounting holes 13c with the screws 47 in relative position as shown in FIG. 1. When the slide plate 13c reverses and the bushing 3 is set closer to the bolt 8 and the crosspiece fin 9 end of the lock 100, for the smaller lock backset settings, the pin 34'a similarly as with the pin 34' will be positioned. The slide plate 13c and the bushing 3a are to be set further back and away from the bolt 8 and the crosspiece fin 9 end of the lock 100 for larger backset settings. The backset plate assembly 13a is turned 180° and set in with the screws 47 in a facing position as shown in FIG. 3 for the still larger backset settings. The pin 34'a which runs parallel with the axis A' contains a groove 61 at its outer end 61' to retain a retaining ring 62. Depending upon the desired backset choice, the pin 34'a is passed through one of a selection of holes 63 of a bridge span 64 and the retainer ring 62 is attached to the groove 61 of the pin 34'a. The bridge span 64 is made of a strip of strong sturdy material or metal. The bridge span 64 runs in a direction parallel to the axis line A. Another end 64' of the span 64 which comes close to the crosspiece fin 9 has a fixedly attached pin 34'b running parallel with the axis A' and enjoins with a hole 65 of a snap-on crosspiece 66 which is securely attached to the crosspiece fin 9. The crosspiece 66 is disposed parallel with the crosspiece fin 9 so that with a 90° rotation of the key in the cylinder 30 the action hereto relaid to the crosspiece fin 9 and the bolt 8 is sufficient to withdraw the bolt 8 completely. A choice of backsets for use with this one lock invention can range in distance almost equal to the entire length (parallel to axis A) of this entire lock, however long the lock may be made to be.

From the inside of a room the lock 100 can be opened by means of the finger knob lever 4 with the shaft 5 centered on the axis A' and extending through the hole 33 in the back casing 16 into the inner lever 6 secured in place thereon by the set screw 6'. The rotating inner lever 6 is similar to the rear rotating lever 21 but has the two pins 34 offset angularly relative to each other about the axis A' by about 90°. The two pins 34 are engageable with the axially outer face of the crosspiece fin 9, like the pin 34'. Since there are two pins, 90° rotation of the knob 4 in either direction will retract the bolt 8.

It is also possible as shown in FIG. 4 to replace the lever 4 and the shaft 5 with a mini-cylinder 45 which is carried on a mount 4a on the rear casing 16 and has a stem 3'a, projecting through the casing 16 into the otherwise identical inner lever 6. This gives a double-cylinder operation that can only be opened manually from inside by a person having the key for the cylinder 45, an installation particularly useful around glass. If the key can be made to be withdrawn from the cylinder 45 in 90° positions, this arrangement can also be used to lock the bolt 8 in the inner position.

The lock 100 of the instant invention can also be retained in the open or unlocked condition. This can be done as shown in FIG. 4 by providing a non-magnetic axial extension 44 on an inner end 11b of the plunger 11. The inner end 11b has a frustoconical surface 11c complementary to a seat 7a in the abutment 7, which also acts as a guide for the extension 44. The free end 44a of the extension 44 is formed with a radially outwardly open groove 44b that is aligned in the open lock position with a threaded bore 27 in a free end 7' of the magnetic attractor abutment 7. A thumb screw 38a threaded into the hole 27 can therefore effectively hold the bolt 8 back against the force of the spring 10. Alternately as shown in FIG. 4 a spring clip 38b engaged in grooves 53 of the magnetic attractor abutment 7 can engage into a groove 67 and also lock the bolt 8 in the unlocked position.

Similarly as best seen in FIG. 5 the bolt guide end plate 1 is formed with a bore 49 extending radially from the hole 40 relative to the axis A and has a threaded outer end 49a. The bolt 8 has a radially opened blind hole 48 alignable therewith. A thumb screw 38 can be screwed into the bore 49 to engage in the blind hole 48 and lock the bolt 8 in place.

Figure 10A:
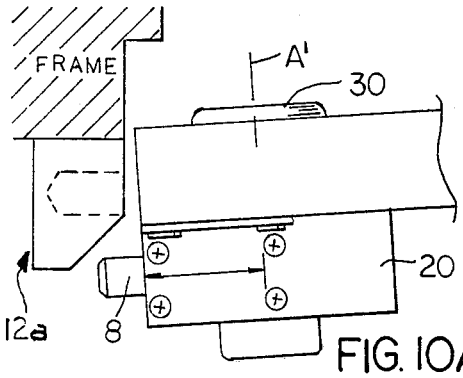
Figure 10:
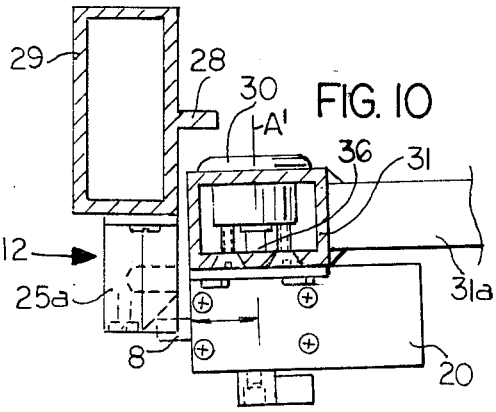

The strikes according to this invention are shown in FIGS. 2, 10, 10A, B and C and 11, 11 A, B and C. The simplest possible strike 12 which is also 23 is a single plate, normally of a durable material made with a central cylidrical bore 12b slightly larger than the bolt 8 and with a ramp 12c extending from it. The strike 12 and 23 can be secured directly by two screws 13i to an inner face 29' of a standard door post 29 of the outswinging type shown in FIGS. 11, in which case a lip 28 forms the stop which has a portion 28a that is cut away for the strike 12 and 33.

A thicker strike 12a as shown in FIG. 10A is otherwise similar to the strike 12 and can be screwed to the inner face 29' of the door frame 29 for use with an inswinging door.

Virtually any installation can be accommodated by the kit shown in brackets to the right in FIG. 2 and basically comprises a strike plate 23 and 12 identical to the strike plate 12 and 23, another plate 23*a*, and two brackets 24 and 24*a*. The plate 23*a* is secured by two wood or self-tapping screws 54 through either of the brackets 24 or 24*a* to the door frame 29, and it has a central blind hole 23*b*. The plate 23 and 12 is secured by two machine screws 56 extending parallel to the axis A to the plate 23*a* and via two further machine screws 57 to one of the brackets 24 or 24*b*, which in turn can be secured by screws 58 to the door frame. These parts can be assembled to form a strike 25 for an outswinging wood door or a strike 25*a* for an outswinging metal door, as shown in FIG. 2. Thus an inexpensive kit of simple parts allows the lock 100 to be adapted to many different installations both inswing and outswing.

Figure 7:
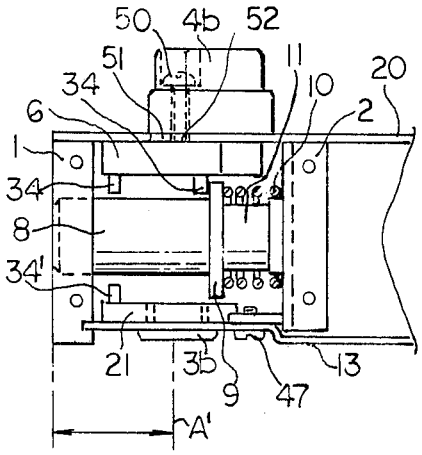
FIG. 7 is a partly broken-away view of the lock as of FIG. 6.
Figure 10C:
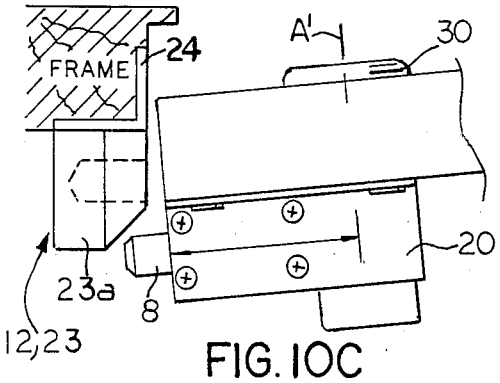
FIGS. 10 to 11C show different applications of the invention.
Figure 10B:
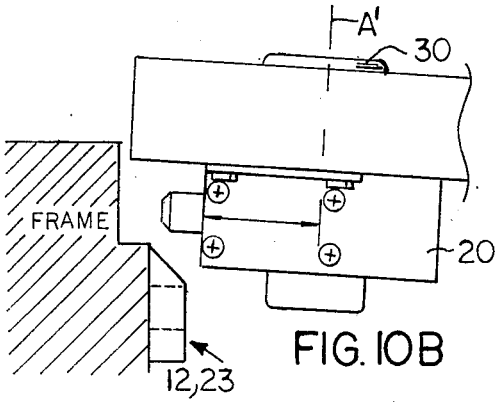

FIGS. 2, 6, and 7 show the lock 100 in which the plunger 11 need not be provided with an extension 44. Instead an inside knob 4*b* is provided with a screw 50 offset from the axis A'. The back casing 16 is formed with a center hole 51 and two side holes 52 around the hole 33. The screw 50 can be screwed down into the hole 51 to lock the knob 4*b* against rotation, thereby making it necessary to use solenoid action to open the door from the inside. The screw 50 can be screwed down into either of the holes 52 also to hold the bolt 8 in the withdrawn position. A screwdriver 55, allen wrench 55*a*, or the like can be used to move the screw 50 in or out. Thus it is possible to change the style of operation of the lock 100 in a very simple manner, using simple tools.

A recessed backset plate may be used, as well as a slightly different coupling bushing. Either way the functioning of this arrangement is identical to that of the embodiments described above.

Figure 11C:
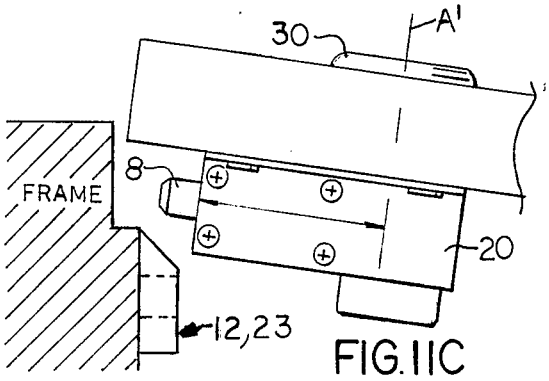
Figure 11B:
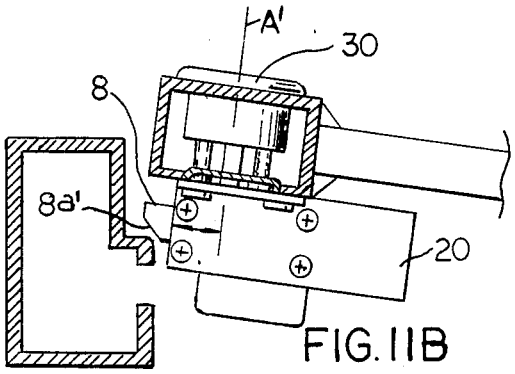
Figure 11A:
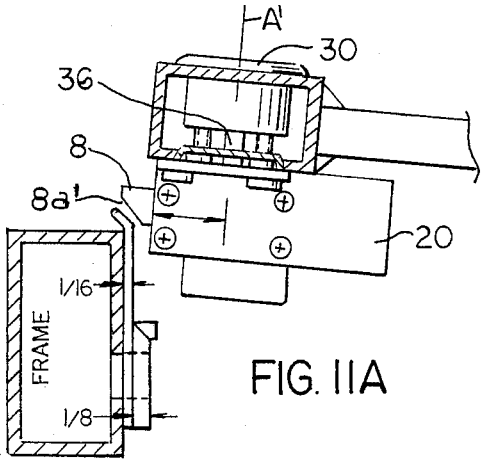
Figure 11:
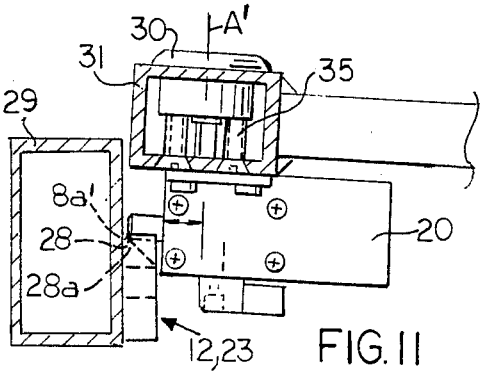

FIGS. 11A and 11B show a lock bolt 8' having a beveled face 8*a*'. This structure allows the bolt 8' to be pushed back into the housing as the door closes.

In the lock of FIGS. 8 and 9, the bolt 8 actually forms the core of a solenoid 17' and has a long extension 44' that carries the crosspiece fin 9' on which the inside knob 4 and outside key cylinder can act. This structure offers certain advantages in extremely tight mounting locations. In particular this arrangement allows the same coil to be used regardless of the overall lock size. In addition only the core of the bolt 8 is magnetic and the outside is aluminum, so that in an aluminum housing there is no sliding of steel or aluminum with the concomitant wear. The ferrous core of the bolt 8 can also be sheathed in brass, nylon or any other well-wearing non-magnetic material.

In this arrangement, also, the housing 20 is effectively divided into a solenoid part and a manual-actuation part, so that the same solenoid arrangement can be used with different backsets. A relatively deep backset can also be accommodated by this arrangement relatively easily.

We claim:

1. In combination with a door post and a door having a stile inwardly engageable therewith and having an outwardly directed front face and an inwardly directed rear face, a rim lock comprising:

(a) a housing secured to the rear stile face and forming a guide extending along a longitudinal axis;

(b) a bolt displaceable in said guide along said longitudinal axis between an inner position generally retracted in said housing and an outer position projecting axially therefrom;

(c) a strike disposed on the door post and being formed with a recess opening axially toward the stile and receiving said bolt in said outer position thereof when the stile engages the door post;

(d) a solenoid mounted on said housing and having a coil centered on said longitudinal axis;

(e) a plunger axially reciprocal in said coil of said solenoid;

(f) a crosspiece fin disposed between and rigidly affixed to said plunger and said bolt;

(g) a front inner lever having at least one pin and being rotationally mounted in said housing and being in mechanical communication with said crosspiece fin;

(h) a spring operatively braced between said crosspiece fin and said housing and urging said bolt axially outward into said outer position to a distance controlled by said front inner lever;

(i) means for electrically energizing said coil of said solenoid and pulling said plunger, said crosspiece fin, and said bolt axially backward against said spring into said inner position of said bolt;

(j) holding means operatively engageable between said bolt and said housing for mechanically retaining said bolt in said inner position;

(k) a key operated lock cylinder having a stem and being disposed on the front face of the stile of the door;

(l) a rear inner lever having at least one pin and being rotationally mounted in said housing and being in mechanical communication with said crosspiece fin;

(m) first coupling means including an interchangeable backset plate engaged between said key-operated lock cylinder and said bolt for displacing said bolt axially upon operation of said key-operated lock cylinder, said interchangeable backset plate being a one of a plurality of interchangeable backset plates each being removably mounted to said housing and each having a different backset so that a single rim lock can fit on doors with different size stiles and required backsets, said each one of said plurality of interchangeable backset plates containing a bushing and a throughbore through which is disposed said bushing, said bushing having an outer face and an inner face rigidly connected to said rear inner lever, said stem of said key-operated lock cylinder being disposed within said outer face of said bushing so that when said key-operated lock cylinder is operated said stem rotates said bushing which rotates said rear inner lever causing said at least one pin of said rear inner lever to move said bolt via said crosspiece fin since said crosspiece fin is rigidly affixed to said bolt;

(n) manual operating means pivotally mounted on said housing, said manual operating means including a finger lever having a shaft with a free end; and (o) second coupling means engageable between said manual operating means and said bolt for displacing said bolt axially upon manual pivoting of said manual operating means, said second coupling means including said free end of said shaft being rigidly connected to said front inner lever so that when said finger lever is rotated said shaft rotates said front inner lever causing said at least one pin of said front inner lever to move said bolt via said crosspiece fin said crosspiece fin is rigidly affixed to said bolt.

2. The combination defined in claim 1, wherein a part of said bolt is said plunger of said solenoid and being sheathed in a jacket made of a non-magnetic material, said housing including said bolt guide made of said non-magnetic material.

3. The combination defined in claim 1, wherein said strike includes a main block, a bracket adapted to be secured to the door post, a backing block, and screws for securing said bracket to said main block, said bracket to the door post, said backing block to the door post, and said main block to said backing block with said main block facing in one direction for an in-swinging door and in the opposite direction for an out-swinging door.

4. The combination defined in claim 1; further comprising latch means including a pin disposed on said finger lever, said pin engaging said housing for arresting said finger lever on said housing in a first position permitting axial motion of said bolt while preventing pivoting of said finger lever and in a second position holding said bolt in said inner position while preventing pivoting of said finger lever.

5. The combination defined in claim 1, wherein said housing has an intermediate partition to which said spring is braced.

6. The combination defined in claim 1; further comprising an inside mini-cylinder mounted on said housing and connected to said front inner lever to rotate said front inner lever.

7. The combination defined in claim 1, wherein said holding means include a radially open recess on said bolt and a hold-in element axially nondisplaceable in said housing and engageable in said radially open recess, said housing being provided with a tubular guide abutment axially aligned with said plunger and disposed on the axially opposite side of said solenoid as said bolt, said said bolt having an axially inwardly projecting extension formed with said radial recess and said hold-in element being carried on said tubular guide abutment, said hold-in element being a screw clip.

8. In combination with a door post and a door having a stile inwardly engageable therewith and having an outwardly directed front face and an inwardly directed rear face, a rim lock comprising:

(a) a housing adapted to be secured to the rear stile face of the door and forming a guide extending along a longitudinal axis;

(b) a bolt displaceable in said guide along said longitudinal axis between an inner position generally retracted in said housing and an outer position projecting axially therefrom;

(c) a strike adapted to be mounted on the door post and being formed with a recess opening axially toward the stile and receiving said bolt in said outer position thereof when the stile engages the door post;

(d) a solenoid having a coil centered on said longitudinal axis and fixed in said housing ;

(e) a plunger axially reciprocal in said coil of said solenoid and fixed on said bolt;

(f) a crosspiece fin disposed between and rigidly affixed to said plunger and said bolt;

(g) a front inner lever having at least one pin and being rotationally mounted in said housing and being in mechanical communication with said crosspiece fin;

(h) a spring operatively braced between said crosspiece fin and said housing and urging said bolt axially outward into said outer position to a distance controlled by said front inner lever;

(i) means for electrically energizing said coil of said solenoid and pulling said plunger and said bolt axially backward against said spring into said inner position of said bolt;

(j) holding means operatively engageable between said bolt and said housing for mechanically retaining said bolt in said inner position;

(k) a key-operated lock cylinder having a stem and being disposed on the front face of the stile of the door;

(l) first coupling means engaged between said key operated lock cylinder and said bolt for displacing said bolt axially upon operation of said key-operated cylinder, said first coupling means including a rear inner lever having at least one pin and being rotationally mounted in said housing and being in mechanical communication with said crosspiece fin;

(m) manual operating means pivotally mounted on said housing, said manual operating means including means including a finger lever having a shaft with a free end; and (n) second coupling means engageable between said manual operating means and said bolt for displacing said bolt axially upon manual pivoting of said manual operating means, said second coupling means including said free end of said shaft being rigidly connected to said front inner lever so that when said finger lever is rotated said shaft rotates said front inner lever causing said at least one pin of said front inner lever to move said bolt via said crosspiece fin since said crosspiece fin is rigidly affixed to said bolt.

9. The combination defined in claim 8, wherein a part of said bolt is said plunger of said solenoid and being sheathed in a jacket made of a non-magnetic material, said housing including said bolt guide made of said non-magnetic material.

10. The combination defined in claim 8, wherein said strike includes a main block, a bracket adapted to be secured to the door post, a backing block, and screws for securing said bracket to said main block, said bracket to the door post, said backing block to the door post, and said main block to said backing block with said main block facing in one direction for an in-swinging door and in the opposite direction for an out-swinging door.

11. The combination defined in claim 8; further comprising latch means including a pin disposed on said finger lever, said pin engaging said housing for arresting said finger lever on said housing in a first position permitting axial motion of said bolt while preventing pivoting of said finger lever and in a second position holding said bolt in said inner position while preventing pivoting of said finger lever.

12. The combination defined in claim 8, wherein said housing has an intermediate partition to which said spring is braced.

13. The combination defined in claim 8; further comprising an inside mini-cylinder mounted on said housing and connected to said front inner lever to rotate said front inner lever.

14. The combination defined in claim 8, wherein said holding means includes a radially open recess on said bolt and a hold-in element axially nondisplaceable in said housing and engageable in said radially open recess, said housing being provided with a tubular guide abutment axially aligned with said plunger and disposed on the axially opposite side of said solenoid as said bolt, said bolt having an axially inwardly projecting extension formed with said radial recess and said hold-in element being carried on said tubular guide abutment, said hold-in element being a screw clip.

15. The combination defined in claim 10; further comprising an inside mini-cylinder mounted on said housing and connected to said front inner lever to rotate said front inner lever.

16. In combination with a door post and a door having a stile inwardly engageable therewith and having an outwardly directed front face and an inwardly directed rear face, a rim lock comprising:

(a) a housing secured to the rear stile face and forming a guide extending along a longitudinal axis;

(b) a bolt displaceable in said guide along said longitudinal axis between an inner position generally retracted in said housing and an outer position projecting axially therefrom;

(c) a strike disposed on the door post and being formed with a recess opening axially toward the stile and receiving said bolt in said outer position thereof when the stile engages the door post;

(d) a solenoid mounted on said housing and having a coil centered on said longitudinal axis;

(e) a plunger axially reciprocal in said coil of said solenoid;

(f) a crosspiece fin disposed between and rigidly affixed to said plunger and said bolt;

(g) a front inner lever having at least one pin and being rotationally mounted in said housing and being in mechanical communication with said crosspiece fin;

(h) a spring operatively braced between said crosspiece fin and said housing and urging said bolt axially outward into said outer position to a distance controlled by said front inner lever;

(i) means for electrically energizing said coil of said solenoid and pulling said plunger, said crosspiece fin, and said bolt axially backward against said spring into said inner position of said bolt;

(j) holding means operatively engageable between said bolt and said housing for mechanically retaining said bolt in said inner position;

(k) a key operated lock cylinder having a stem and being disposed on the front face of the stile of the door;

(l) first coupling means including an adjustable backset plate engaged between said key-operated lock cylinder and said bolt for displacing said bolt axially upon operation of said key-operated lock cylinder, said adjustable backset plate having an infinite number of backsets so that a single rim lock can fit on doors with different size stiles and required backsets, said adjustable backset plate having two sides and containing a throughbore and a slot running along said longitudinal axis and having tracks on a first side of said two sides of said adjustable backset plate, a bushing having an inner face and an outer face, a cam containing a throughbore, a square slide plate containing a throughbore and having tracks mating with said tracks of said slot contained in said first side of said adjustable backset plate, a rectangular slide plate disposed on a second side of said two sides of said adjustable backset plate and containing a slot along said longitudinal axis and a throughbore through which is disposed said bushing, said inner face of said bushing passing through said throughbore in said rectangular slide plate through said slot in said adjustable backset plate through said square sliding plate and being rigidly affixed in said throughbore of said cam, a screw passing through said slot in said rectangular slide bar and terminating in said throughbore on said adjustable backset plate, said rectangular slide plate with said bushing being movable along said longitudinal axis until the required backset is achieved at which time said screw is secured into said throughbore in said adjustable backset plate;

(m) manual operating means pivotally mounted on said housing, said manual operating means including a finger lever having a shaft with a free end; and (n) second coupling means engageable between said manual operating means and said bolt for displacing said bolt axially upon manual pivoting of said manual operating means, said second coupling means including said free end of said shaft being rigidly connected to said front inner lever so that when said finger lever is rotated said shaft rotates said front inner lever causing said at least one pin of said front inner lever to move said bolt via said crosspiece fin since said crosspiece fin is rigidly affixed to said bolt.

17. The combination defined in claim 16, wherein a part of said bolt is said plunger of said solenoid and being sheathed in a jacket made of a non-magnetic material, said housing including said bolt guide made of said non-magnetic material.

18. The combination defined in claim 16, wherein said strike includes a main block, a bracket adapted to be secured to the door post, a backing block, and screws for securing said bracket to said main block, said bracket to the door post, said backing block to the door post, and said main block to said backing block with said main block facing in one direction for an in-swinging door and in the opposite direction for an out-swinging door.

19. The combination defined in claim 16; further comprising latch means including a pin disposed on said finger lever, said pin engaging said housing for arresting said finger lever on said housing in a first position permitting axial motion of said bolt while preventing pivoting of said finger lever and in a second position holding said bolt in said inner position while preventing pivoting of said finger lever.

20. The combination defined in claim 16, wherein said housing has an intermediate partition to which said spring is braced.

21. The combination defined in claim 16, wherein said holding means include a radially open recess on said bolt and a hold-in element axially nondisplaceable in said housing and engageable in said radially open recess, said housing being provided with a tubular guide abutment axially aligned with said plunger and disposed on the axially opposite side of said solenoid as said bolt, said bolt having an axially inwardly projecting extension formed with said radial recess and said hold-in element being carried on said tubular guide abutment, said hold-in element being a screw clip.

* * * * *